US008988306B2

(12) United States Patent
Kuo et al.

(10) Patent No.: US 8,988,306 B2
(45) Date of Patent: Mar. 24, 2015

(54) MULTI-FEED ANTENNA

(75) Inventors: Yen-Liang Kuo, Taoyuan County (TW); Wan-Ming Chen, Taoyuan County (TW)

(73) Assignee: HTC Corporation, Taoyuan District, Taoyuan (TW)

( * ) Notice: Subject to any disclaimer, the term of this patent is extended or adjusted under 35 U.S.C. 154(b) by 257 days.

(21) Appl. No.: 13/294,187

(22) Filed: Nov. 11, 2011

(65) Prior Publication Data

US 2013/0120218 A1 May 16, 2013

(51) Int. Cl.
*H01Q 3/22* (2006.01)
*H01Q 9/42* (2006.01)
*H01Q 3/24* (2006.01)

(52) U.S. Cl.
CPC ... *H01Q 9/42* (2013.01); *H01Q 3/24* (2013.01)
USPC ..... 343/876

(58) Field of Classification Search
CPC ..... H01Q 3/22
USPC ..... 343/876
See application file for complete search history.

(56) References Cited

U.S. PATENT DOCUMENTS

| | | | | |
|---|---|---|---|---|
| 6,639,555 | B1 | 10/2003 | Kane | |
| 6,753,815 | B2 | 6/2004 | Okubora | |
| 6,759,897 | B2 * | 7/2004 | Ciemniak | 327/553 |
| 7,375,689 | B2 | 5/2008 | Chen | |
| 7,760,150 | B2 | 7/2010 | Sato | |
| 8,094,076 | B2 | 1/2012 | Zhang | |
| 2005/0181847 | A1 * | 8/2005 | Boyle | 455/575.7 |
| 2006/0192720 | A1 * | 8/2006 | Shtrom | 343/795 |
| 2008/0258993 | A1 * | 10/2008 | Gummalla et al. | 343/876 |
| 2009/0115674 | A1 | 5/2009 | Fujieda | |
| 2011/0043415 | A1 | 2/2011 | Chang | |
| 2011/0102290 | A1 | 5/2011 | Milosavljevic | |
| 2011/0241962 | A1 | 10/2011 | Chen | |

FOREIGN PATENT DOCUMENTS

| | | | |
|---|---|---|---|
| CN | 101662070 | A | 3/2010 |
| CN | 201498592 | U | 6/2010 |
| CN | 101997160 | A | 3/2011 |
| DE | 112009001935 | T5 | 2/2012 |
| EP | 0892459 | A1 | 1/1999 |
| EP | 1608035 | A1 | 12/2005 |
| EP | 2005516 | B1 | 6/2011 |

(Continued)

OTHER PUBLICATIONS

Office action mailed on Mar. 18, 2013 for the DE application No. 102012220366.4, p. 1-6.

(Continued)

*Primary Examiner* — Dameon E. Levi
*Assistant Examiner* — Andrea Lindgren Baltzel
(74) *Attorney, Agent, or Firm* — Winston Hsu; Scott Margo

(57) ABSTRACT

A multi-feed antenna is disclosed. The multi-feed antenna includes a first feed terminal, a second feed terminal, a first ground terminal, a second ground terminal, a radiator and a control circuit. The radiator is coupled to the first feed terminal, the second feed terminal, the first ground terminal and the second ground terminal. The control circuit is coupled to the first feed terminal and the second feed terminal and used for switching a radio frequency (RF) signal between the first feed terminal to the first ground terminal and the second feed terminal to the second ground terminal.

11 Claims, 7 Drawing Sheets

(56) References Cited

FOREIGN PATENT DOCUMENTS

| | | | |
|---|---|---|---|
| EP | 2523253 | A1 | 11/2012 |
| JP | 06085643 | A | 3/1994 |
| JP | 2004253943 | A | 9/2004 |
| TW | I319642 | | 1/2010 |
| TW | I323528 | | 4/2010 |
| WO | 0191235 | A1 | 11/2001 |
| WO | 2006103311 | A2 | 10/2006 |
| WO | 2007037829 | A2 | 4/2007 |
| WO | 2008101119 | A1 | 8/2008 |
| WO | 2009027579 | A1 | 3/2009 |

OTHER PUBLICATIONS

Songnan Yang et al., "Frequency-Reconfigurable Antennas for Multiradio Wireless Platforms", Feb. 2009, p. 66-83, vol. 10, No. 1, IEEE Microwave Magazine.

Office action mailed on Aug. 18, 2014 for the China application No. 201210251165.7, filing date Jul. 19, 2012.

* cited by examiner

MULTI-FEED ANTENNA

BACKGROUND OF THE INVENTION

1. Field of the Invention

The present disclosure relates to a multi-feed antenna, and more particularly, to a multi-feed antenna capable of switching between different feed terminals via a control circuit.

2. Description of the Prior Art

The antenna is utilized for transmitting or receiving radio waves, so as to transmit or to exchange radio signals. Generally speaking, electronic products with communication function of Wireless Local Area Network (WLAN), such as laptops, mobile phones, tablets, or other hand-held devices having communication function, utilize internal antennas for accessing a wireless network. With progress of communication technology, the operating frequencies of different wireless communication systems may be different, for example, a carrier central frequency of Wireless Local Area Network standard 802.11a set by Institute of Electrical and Electronics Engineers (IEEE) is about 5 GHz and a carrier central frequency of IEEE 802.11b is about 2.4 GHz. Therefore, in order to allow users to access different wireless communication network more conveniently, an ideal antenna should be capable of covering different desired frequency bands of different wireless communication network in single antenna. Besides, the size of the ideal antenna should be as small as possible, so as to match the trends of degrading size of the wireless communication device and to integrate the antenna in the wireless communication device.

With the continuously increasing of demand and quality of the wireless communication system, broadband antenna and the multi-band antenna are not only for fulfilling the requirement of bandwidth but for improving the quality of communication, especially for improving the quality of communicating on phones. As to insufficient bandwidth, there are practical difficulties of designing Planar Inverted F antenna (PIFA) with multi frequency bands if multiple desired frequency bands are close. In addition, a coupling on the resonant path of the Planar Inverted F antenna of multi frequency bands complicates the design of Planar Inverted F antenna of multi frequency bands. Generally speaking, a tradeoff between bandwidth and performance of the broadband Planar Inverted F antenna decreases the area of antenna. As to poor quality of communicating on the phones, the performance of the antenna of mobile phone could degrade because of effects of human body, such as the methods/position of hand holding or the antenna is too close to human body, and could degrade the quality of communication.

SUMMARY OF THE INVENTION

Therefore, the present disclosure mainly provides a multi-feed antenna for changing a field pattern of the multi-feed antenna through changing a feeding point.

The present disclosure discloses a multi-feed antenna. The multi-feed antenna comprises a first feed terminal; a second feed terminal; a first ground terminal; a second ground terminal; a radiator and a control circuit. The radiator is coupled to the first feed terminal, the first ground terminal, the second feed terminal and the second ground terminal. The control circuit is coupled to the first feed terminal and the second feed terminal and used for switching a radio frequency (RF) between the first feed terminal to the first feed ground terminal and the second feed terminal to the second ground terminal.

The present disclosure further discloses a multi-feed antenna. The multi-feed antenna comprises a first feed terminal; a second feed terminal; a first ground terminal; a second ground terminal; a first radiator; a second radiator; and a control circuit. The first radiator is couple to the first feed terminal and the first ground terminal. The second radiator is coupled to the second feed terminal and the second ground terminal. The control circuit is coupled to the first feed terminal and the second feed terminal and used for switching a radio frequency (RF) signal between the first feed terminal to the first ground terminal and the second feed terminal to the second ground terminal.

These and other objectives of the present disclosure will no doubt become obvious to those of ordinary skill in the art after reading the following detailed description of the preferred example that is illustrated in the various figures and drawings.

DETAILED DESCRIPTION

Figure 1:
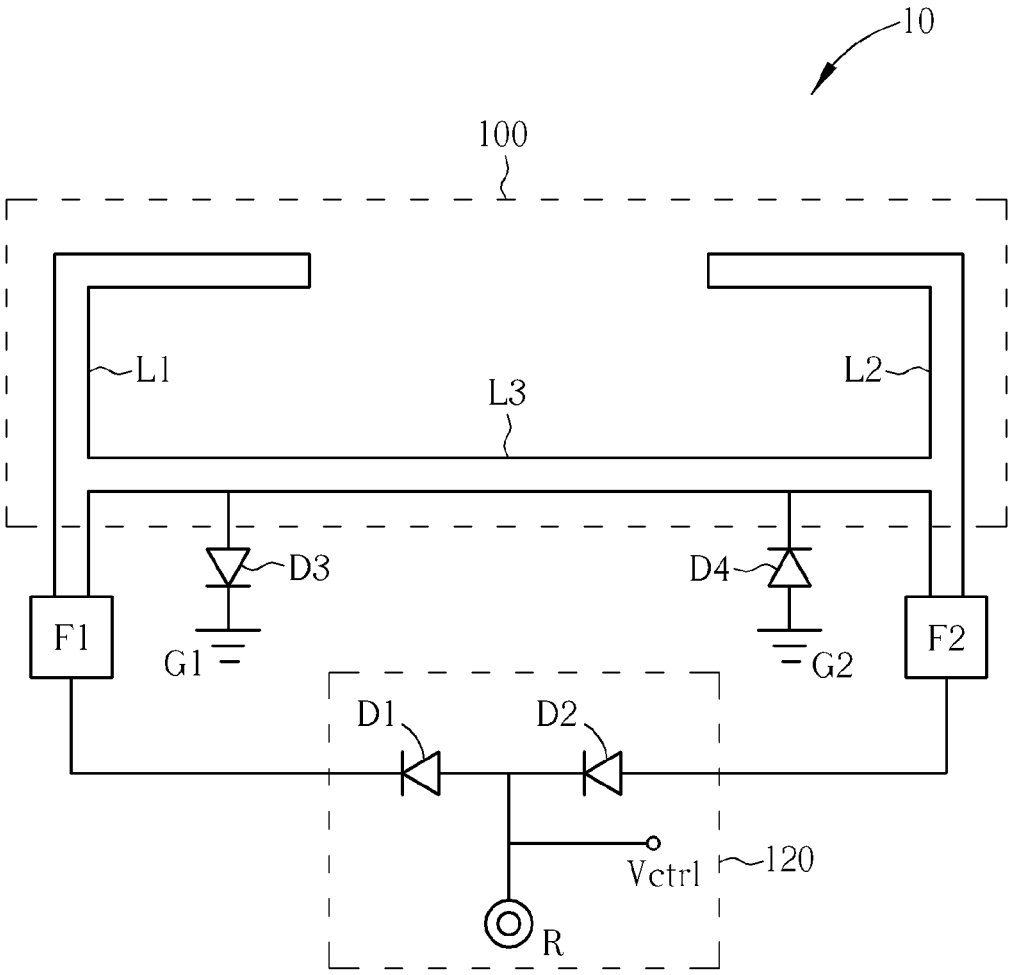
FIG. 1 is a schematic diagram of a multi-feed antenna according to an example of the present disclosure.

Please refer to FIG. 1, which is a schematic diagram of a multi-feed antenna 10 according to an example of the present disclosure. The multi-feed antenna 10 includes a feed terminal F1, a feed terminal F2, a ground terminal G1, a ground terminal G2, a radiator 100 and a control circuit 120. The radiator 100 comprises at least a metal strip L1, a metal strip L2, and a metal strip L3. Preferably, the metal strip L1 and the metal strip L2 are L-shaped. The metal strip L1 has a first terminal open and a second terminal coupled to the feed terminal F1. The metal strip L2 has a first terminal open and a second terminal coupled to the feed terminal F2. The metal strip L3 has a first terminal coupled to second terminal of the metal strip L1 (i.e. the feed terminal F1) and the second terminal coupled to the second terminal of the metal strip L2 (i.e. the feed terminal F2). In the present example, preferably, the shape and the size of the metal strip L1 and the metal strip L2 are the same and symmetric. Therefore, the metal strip L1, the metal strip L2 and the metal strip L3 form two opposite notches. The control circuit 120 is capable of switching the feed terminal of radio frequency (RF) signal. The control circuit 120 includes a transceiver R for transmitting/receiving wireless signals (such as RF signal); a diode D1 having a positive terminal coupled to the transceiver R and a negative terminal coupled to the feed terminal F1; a diode D2 having a positive terminal coupled to the feed terminal F2 and a negative terminal coupled to the transceiver R and the positive terminal of the diode D1; and a control voltage Vctr1 coupled to the transceiver R, the positive terminal of the diode D1 and the negative terminal of diode D2 and used for controlling the conducting states of the diode D1 and the diode D2. Besides, the multi-feed antenna further includes a diode D3 having a positive terminal coupled to the metal strip L3 and a negative terminal coupled to the ground terminal G1; and a diode D4 having a positive terminal coupled to the ground terminal G2 and a negative terminal coupled to the metal strip L3. The method of configuration of the diode D1-D4 is not limited to the connection method above mentioned, and those skilled in the art can alter the connection of each diode according to different applications.

Figure 2:
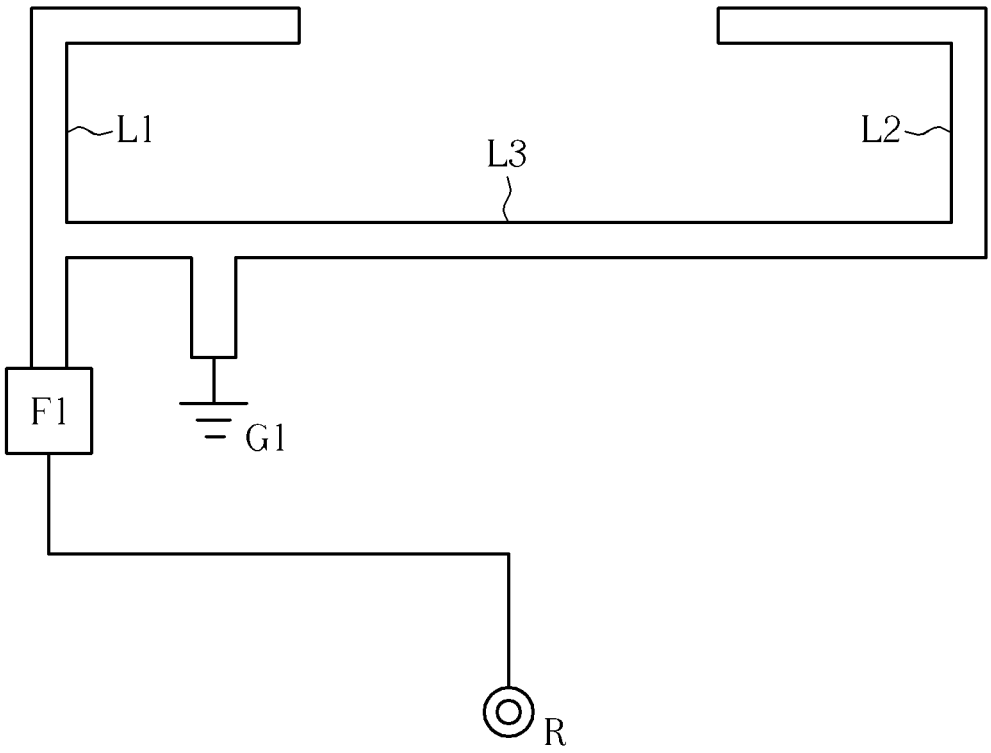
FIG. 2 is a schematic diagram of the multi-feed antenna shown in FIG. 1 when a control voltage is a positive voltage.
Figure 3:
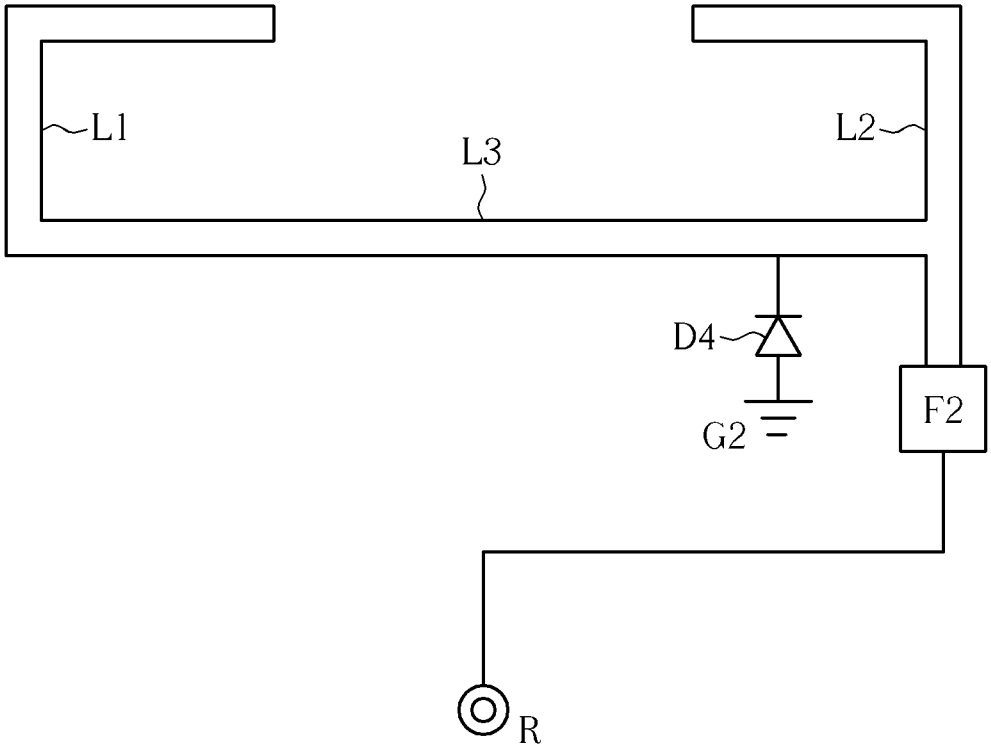
FIG. 3 is a schematic diagram of the multi-feed antenna shown in FIG. 1 when a control voltage is a negative voltage.

Please refer to an example shown in FIG. 2, the multi-feed antenna 10 can be designed at any position of a hand-held device (not shown herein) when the multi-feed antenna 10 is configured into the hand held device. Preferably, the multi-feed antenna 10 is designed at the top or the bottom of the hand-held device. When the holding position of the user is too close to the metal strip L2, the user affects the radiation performance of the multi-feed antenna 10. In order to improve the disadvantage in the prior art, the feed terminal of the RF signal can be adaptively switched according to different operating environments or different methods of hand-holding through the existed electronic components (such as CPU, RF circuit, detecting circuit, etc.) which cooperates with the control circuit 120 to switch a transmission path of the RF signal from a resonant path to another resonant path and maintain the communication quality of the multi-feed antenna 10. For example, please refer to FIG. 2, which is a schematic diagram of the multi-feed antenna 10 when the control voltage Vctr1 is a positive voltage. As shown in FIG. 2, the diode D1 and the diode D3 are conducted, and the diode D2 and the diode D4 are cut-off when the control voltage Vctr1 provides a positive voltage. Therefore, the RF signal is fed from the feed terminal F1, such that the metal strip L1 can transmit and receive a high frequency band signal, and the metal strip L2 and the metal strip L3 can transmit and receive a low frequency band signal. Please refer to FIG. 3, which is a schematic diagram of the multi-feed antenna 10 when the holding position of the user is too close to the metal strip L1 and the control voltage Vctr1 is a negative voltage. As shown in FIG. 3, the diode D2 and the diode D4 are conducted, and the diode D1 and the diode D3 are cut-off when the control voltage Vctr1 provides a negative voltage. Therefore, the RF signal is fed from the feed terminal F2, such that the metal strip L2 can transmit and receive a high frequency band signal, and the metal strip L1 and the metal strip L3 can transmit and receive a low frequency band signal.

Therefore, the control circuit 120 is coupled to the feed terminal F1 and the feed terminal F2, and controls the conducting states of the diode D1 and the diode D2 through outputting the positive voltage or the negative voltage. In other words, the control circuit 120 changes the feeding terminal of the multi-feed antenna 10 and accordingly lowers the effect of human body to the multi-feed antenna 10. Besides, the ground terminal of the multi-feed terminal is also changed according to the control voltage Vctr1 is a positive voltage or a negative voltage. Understandably, different feed terminals corresponds to different field patterns of antenna and the different field patterns also corresponds to different radiation abilities, thus, the overall performance of the multi-feed antenna 10 can be improved.

Figure 4:
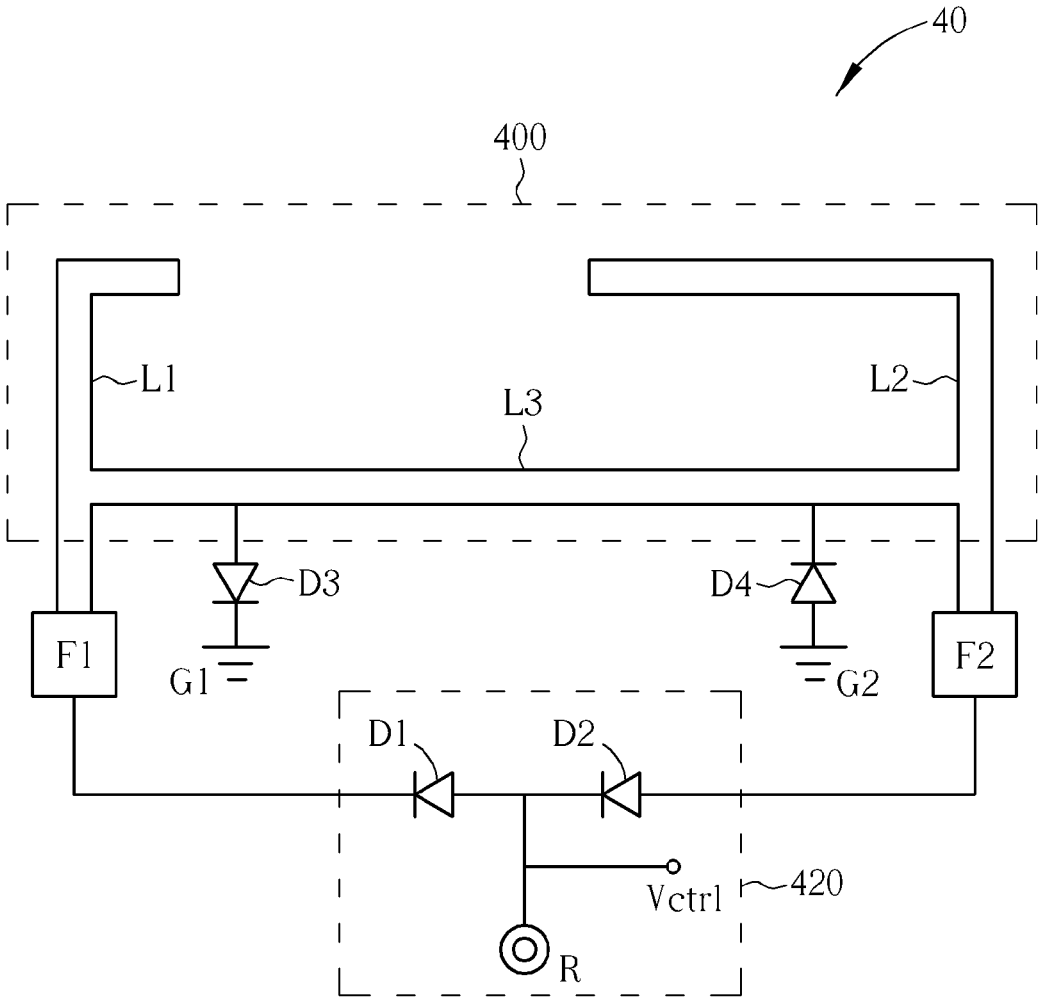
FIG. 4 is a schematic diagram of an asymmetric multi-feed antenna according to an example of the present disclosure.

Noticeably, the metal strip L1 and the metal strip L2 could be different or asymmetric. In other words, the multi-feed antenna 10 can be an asymmetric type. Please refer to FIG. 4, which is a schematic diagram of an asymmetric multi-feed antenna 40 according to an example of the present disclosure. The multi-feed antenna 40 is similar to the multi-feed antenna 10. Therefore, identical components use identical symbols and names. The difference between the multi-feed antenna 40 and the multi-feed antenna 10 is that a length of the metal strip L1 is different from a length of the metal strip L2, wherein the length of the metal strip L1 could be larger than the length of the metal strip L2 or the length of the metal strip L1 also could be smaller than the length of the metal strip L2. In other words, when the control voltage Vctr1 provides a positive voltage, the RF signal is fed from the feed terminal F1, such that the metal strip L1 can transmit and receive a high frequency band signal B1, and the metal strip L2 and the metal strip L3 can transmit and receive a low frequency band signal B2. When the control voltage Vctr1 provides a negative voltage, the RF signal is fed from the feed terminal F2, such that the metal strip L2 can transmit and receive a high frequency band signal B3, and the metal strip L1 and the metal strip L3 can transmit and receive a low frequency band signal B4. When the feed terminal of the multi-feed antenna 40 is adaptively switched, a central frequency of the high frequency band signal B1 is higher than a central frequency of the high frequency band signal B3, i.e. a bandwidth of the high frequency band signal is between the high frequency band signal B1 and the high frequency band signal B3, and a central frequency of the low frequency band signal B4 is higher than a central frequency of the low frequency band signal B2, i.e. a bandwidth of the low frequency band signal is between the low frequency band signal B4 and the low frequency band signal B2. In comparison with the multi-feed antenna 10, the multi-feed antenna 40 not only can degrade the effect of human body to the multi-feed antenna 40 but can cover broader bandwidth through switching different feed terminals of the RF signal. In addition, those skilled in the art also can change the corresponding bandwidth through changing the distance between the feed terminal F1 and the feed terminal F2, and is not limited thereto.

Figure 5:
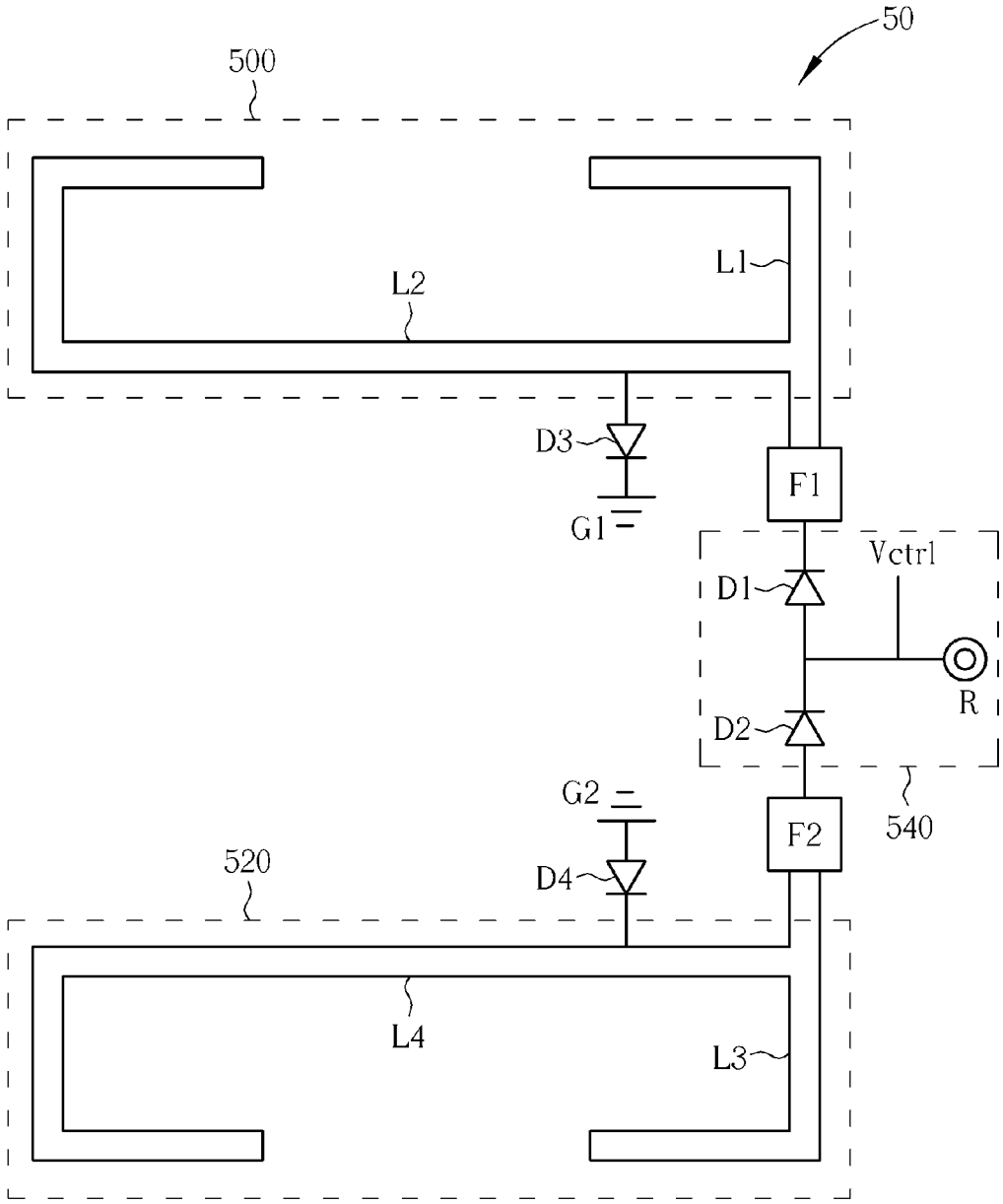
FIG. 5 is a schematic diagram of another asymmetric multi-feed antenna according to an example of the present disclosure.

Please refer to FIG. 5, which is a schematic diagram of a multi-feed antenna 50 according to an example of the present disclosure. A structure of the multi-feed antenna 50 is similar to the structure of multi-feed antenna 10, thus identical components use identical symbols and the same name. A difference between the multi-feed antenna 50 and the multi-feed antenna 10 is that an arrangement of the radiators is slightly different when the multi-feed antenna 50 is configured on a hand-held device. As shown in FIG. 5, the multi-feed antenna 50 includes a radiator 500 and a radiator 520. The radiator 500 includes a metal strip L1 and a metal strip L2 and is configured at the upper portion of the hand-held device. The metal strip L1 is L-shaped and the metal strip L2 is notch-shaped. The metal strip L1 has a first terminal open and a second terminal coupled to a feed terminal F1. The metal strip L2 has a first terminal open and a second terminal coupled to the feed terminal F1. The radiator 520 includes a metal strip L3 and a metal strip L4 and is configured at lower portion of the hand-held device. Similarly, the metal strip L3 is L-shaped and the metal strip L4 is notch-shaped. The metal strip L3 has a first terminal open and a second terminal coupled to a feed terminal F2. The metal strip L4 has a first terminal open and a second terminal coupled to the feed terminal F2. Preferably, shapes of the metal strip L1 and the metal strip L3 are symmetric to the shapes of the metal strip L2 and the metal strip L4. A control circuit 540 is used for switching a feed terminal of the RF signal, wherein the control circuit 540 includes a transceiver R for transmitting and receiving the RF signal; a diode D1 having a positive terminal coupled to the transceiver R and a negative terminal coupled to the feed terminal F1; a diode D2 having a positive terminal coupled to the feed terminal F2 and a negative terminal coupled to the transceiver R; and a control voltage Vctr1 coupled to the transceiver R, the positive terminal of the feed terminal F1 and the negative terminal of the feed terminal F2 for controlling the conducting states of the diode D1 and the diode D2. Similarly, the multi-feed antenna 50 further comprises a diode D3 having a positive terminal coupled to the metal strip L2 and a negative terminal coupled to the ground terminal G1; and a diode D4 having a positive terminal coupled to the ground terminal G2 and a negative terminal coupled to the metal strip L4.

Similarly, the radiation performance is affected when the holding position of the user is too close to the radiator of the multi-feed antenna 50. Therefore, when the control voltage Vctr1 provides a positive voltage, the diode D1 and the diode D3 are conducted and the diode D2 and the diode D4 are cut-off. In other words, the upper portion of the multi-feed antenna 50 is conducted and the lower portion of the multi-feed antenna is cut-off when the control voltage Vctr1 provides a positive voltage. The RF signal is fed from the feed terminal F1, such that the metal strip L1 can transmit and receive a high frequency band signal and the metal strip L2 can transmit and receive a low frequency band signal. When the control voltage Vctr1 provides a negative voltage, the diode D2 and the diode D4 are conducted and the diode D1 and the diode D3 are cut-off. In other words, the lower portion of the multi-feed antenna 50 is conducted and the upper portion of the multi-feed antenna 50 is cut-off. Therefore, the RF signal is fed from the feed terminal F2, such that the metal strip L3 can transmit and receive a high frequency band signal and the metal strip L4 can transmit and receive a low frequency band signal. Though switching the feed terminal of the RF signal, the effect of the human body to the multi-feed antenna can be lowed. Noticeably, those skilled in the art can adjust the lengths of the metal strip L1-L4 according to different applications, such that the multi-feed antenna 50 can transmit and receive broader range of the frequency band signal, and is not limited thereto.

Figure 6:
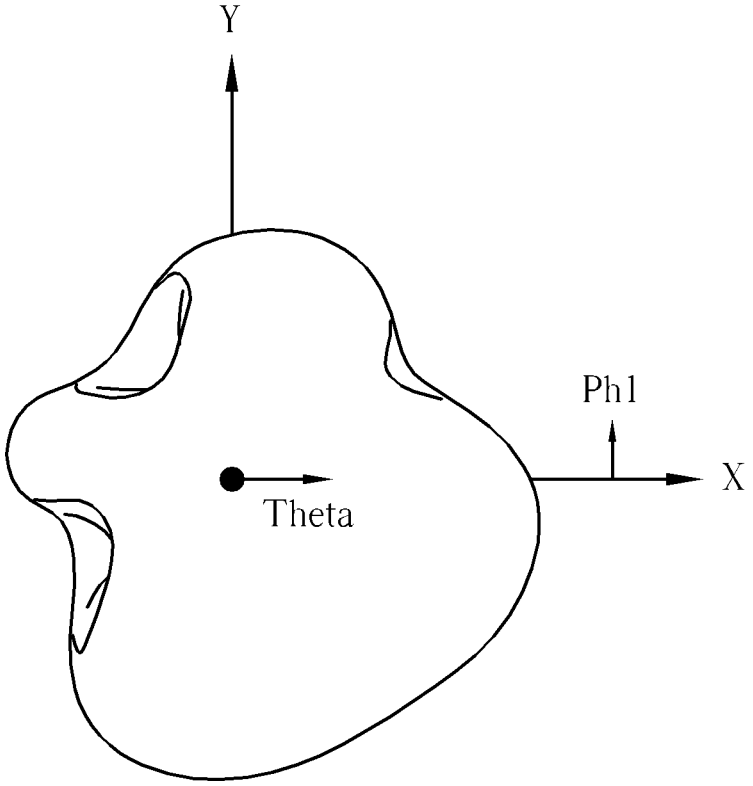
FIG. 6 is a field pattern diagram of a multi-feed antenna according to an example of the present disclosure.
Figure 7:
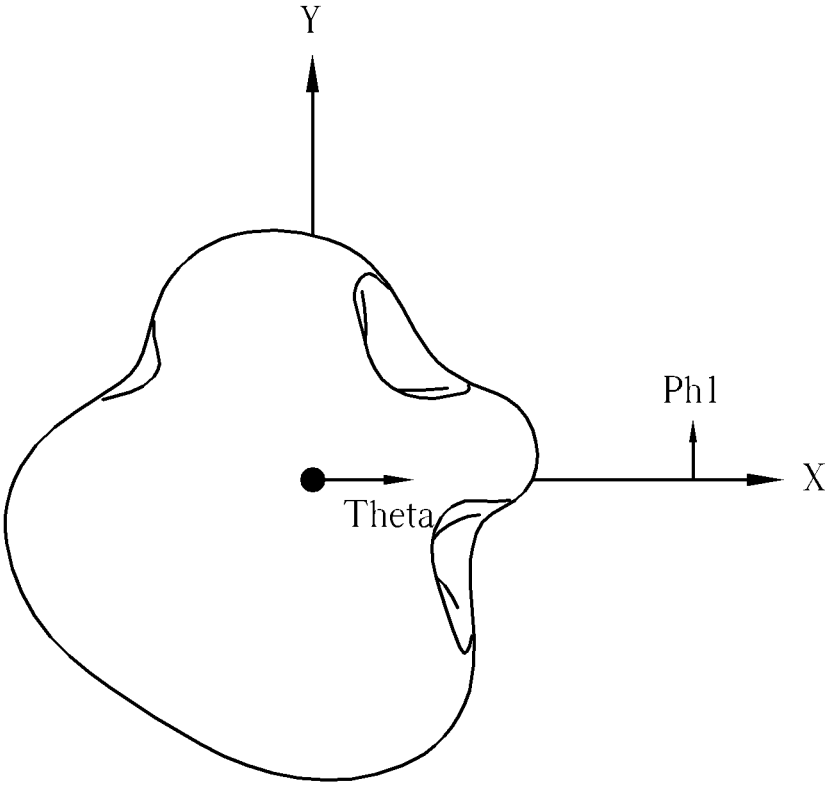
FIG. 7 is another field pattern diagram of a multi-feed antenna according to an example of the present disclosure.

Please refer to FIG. 6, which is a field pattern of a multi-feed antenna according to the example shown in FIG. 1 and FIG. 2 of the present disclosure. In FIG. 6, a position of a feed point is close to the bottom and left half of the antenna when the control voltage Vctr1 is a positive voltage, so there are two null points at bottom and left separately in the field pattern diagram. Please refer to FIG. 7, which is a field pattern of the multi-feed antenna according to the example shown in FIG. 1 and FIG. 3 of the present disclosure. In the FIG. 7, a position of a feed point is close to bottom and right half of the multi-feed antenna, so there are two null points separately at bottom and at right of the field pattern diagram. Therefore, when the metal strip L1 and the metal strip L2 are symmetric, the present disclosure can change the radiation pattern of the antenna according to the operation methods (i.e. the holding methods of the user) through switching the feed terminal and the ground terminal simultaneously. As a result, the present disclosure can prevent effects of radio waves to human and can acquire better antenna performance through changing the field pattern of the antenna. On the other hand, when the metal strip L1 and the metal strip L2 are asymmetry, the present disclosure further broadens the bandwidth of the frequency band signal.

To sum up, the multi-feed antenna of the present disclosure includes a control circuit for changing the feed terminals of the multi-feed antenna. Through changing the feed terminals of the multi-feed antenna, the different radiation pattern can be obtained, so as to improve overall performance of the multi-feed antenna. On the other hand, through changing the feed terminals of the multi-feed antenna and changing lengths of the metal strips, the multi-feed antenna of the present disclosure can transmit and receive wireless signals in a broader bandwidth.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-feed antenna, comprising:
- a first feed terminal;
- a second feed terminal;
- a first ground terminal;
- a second ground terminal;
- a radiator coupled to the first feed terminal, the second feed terminal, the first ground terminal and the second ground terminal, wherein the single radiator is integrally formed; and
- a control circuit coupled to the first feed terminal and the second feed terminal, for switching a radio frequency (RF) signal between the first feed terminal to the first ground terminal and the second feed terminal to the second ground terminal, wherein the control circuit comprises:
- a transceiver for transmitting and receiving the RF signal;
- a first diode comprising a positive terminal coupled to the transceiver and a negative terminal coupled to the first feed terminal;
- a second diode comprising a positive terminal coupled to the second feed terminal and a negative terminal coupled to the positive terminal of the first diode and to the transceiver; and
- a control voltage, coupled to the transceiver, the positive terminal of the first diode and the negative terminal of the second diode and used for controlling the conducting state of the first diode and the second diode.

2. The multi-feed antenna of claim 1, wherein the radiator comprises: a first L-shaped metal strip having a first terminal open and a second terminal coupled to the first feed terminal; and a second L-shaped metal strip having a first terminal open and a second terminal coupled to the second feed terminal.

3. The multi-feed antenna of the claim 2, wherein the radiator further comprises:
- a third metal strip comprising a first terminal coupled to the second terminal of the first L-shaped metal strip and a second terminal coupled to the second terminal of the second L-shaped metal strip;
- a third diode comprising a positive terminal coupled to the third metal strip and a negative coupled to the first ground terminal; and
- a fourth diode comprising a positive terminal coupled to the second ground terminal and a negative terminal coupled to the third metal strip.

4. The multi-feed antenna of claim 1, wherein the first diode and the third diode are conducted for allowing the first L-shaped metal strip to transmit/receive a first frequency band signal and allowing the second L-shaped metal strip and the third metal strip to transmit/receive a second frequency band signal when the control voltage is a positive voltage; and the second diode and the fourth diode the are conducted for allowing the second L-shaped metal strip to transmit/receive a third frequency band signal and allowing the first L-shaped metal strip and the third metal strip to transmit/receive a fourth frequency band signal when the control voltage is a negative voltage.

5. The multi-feed antenna of claim 4, wherein a central operating frequency of the first frequency band signal equals to a central operating frequency of the third frequency band signal and a central operating frequency of the second frequency band signal equals to a central operating frequency of the fourth frequency band signal, wherein the first L-shaped metal strip and the second L-shaped metal strip are symmetric.

6. The multi-feed antenna of claim 4, wherein a central operating frequency of the first frequency band signal is larger than a central operating frequency of the third frequency band signal and a central operating frequency of the second frequency band signal is smaller than a central operating frequency of the fourth frequency band signal, wherein the first L-shaped metal strip and the second L-shaped metal strip are asymmetric.

7. A multi-feed antenna, comprising a first feed terminal;

a second feed terminal;

a first ground terminal;

a second ground terminal;

a first radiator coupled to the first feed terminal and the first ground terminal;

a second radiator coupled to the second feed terminal an the second ground terminal; and a control circuit coupled to the first feed terminal and the second terminal, for switching a radio frequency (RF) signal between the first feed terminal to the first ground terminal and the second feed terminal to the second ground terminal, wherein the control circuit comprises:

a transceiver for transmitting and receiving a RF signal;

a first diode comprising a positive terminal coupled to the transceiver and a negative terminal coupled to the first feed terminal;

a second diode comprising a positive terminal coupled to the second feed terminal and a negative terminal coupled to the first diode terminal of the first diode and the transceiver; and a control voltage coupled to the transceiver, the positive terminal of the first diode and the negative terminal of the second diode, for controlling the conducting state of the first diode and the second diode.

8. The multi-feed antenna of claim 7, wherein the first radiator further comprises:

a third diode comprising a positive terminal coupled to a first notch-shaped metal strip and a negative terminal coupled to the first ground terminal; and the second radiator further comprises:

a fourth diode comprising a positive terminal coupled to the second ground terminal and a negative terminal coupled to the second notch-shaped metal strip.

9. The multi-feed antenna of claim 8, wherein the first diode and the third diode are conducted for allowing the first L-shaped metal strip to transmit/receive the first frequency band signal corresponding to the first frequency band and allowing the first notch-shaped metal strip to transmit/receive the second frequency band signal corresponding to the second frequency band when the control voltage is a positive voltage; and the second diode and the ~fourth diode are conducted for allowing the second L-shaped metal strip to transmit/receive the third frequency band signal corresponding to the third frequency band and allowing the second notch-shaped metal strip to transmit/receive the fourth frequency band signal corresponding to the fourth frequency band.

10. The multi-feed antenna of claim 9, wherein a central operating frequency of the first frequency band signal equals to a central operating frequency of the third frequency band signal and a central operating frequency of the second frequency band signal equals to a central operating frequency of the fourth frequency band signal, wherein the first L-shaped metal strip and the first notch-shaped metal strip are symmetric to the second L-shaped metal strip and the second notch-shaped metal strip.

11. The multi-feed antenna of claim 9, wherein a central operating frequency of the first frequency band signal is larger than a central operating frequency of the third frequency band signal and a central operating frequency of the second frequency band signal is smaller than a central operating frequency of the fourth frequency band signal, wherein the first L-shaped metal strip and the first notch-shaped metal strip are asymmetric to the second L-shaped metal strip and the second notch-shaped metal strip.

* * * * *